US005546652A

United States Patent [19]

Ogata et al.

[11] Patent Number: 5,546,652

[45] Date of Patent: Aug. 20, 1996

[54] AMORPHOS CORE/COIL ASSEMBLING APPARATUS

[75] Inventors: Toshio Ogata; Masanori Yoshizaki, both of Nakajo-machi; Kenji Taguchi, Shibata, all of Japan

[73] Assignee: Hitachi, Ltd., Tokyo, Japan

[21] Appl. No.: 297,839

[22] Filed: Aug. 30, 1994

[30] Foreign Application Priority Data

Aug. 31, 1993 [JP] Japan ..... 5-215951

[51] Int. Cl.[6] ..... H01F 41/02

[52] U.S. Cl. ..... 29/738; 29/606; 29/609; 29/759; 29/760

[58] Field of Search ..... 29/606, 609, 602.1, 29/738, 759, 760

[56] References Cited

U.S. PATENT DOCUMENTS 4,734,975 4/1988 Ballard et al. ..... 29/606

5,226,222 7/1993 Hanoaka et al. ..... 29/606

5,426,846 6/1995 White et al. ..... 29/606 X

*Primary Examiner*—Carl E. Hall

*Attorney, Agent, or Firm*—Antonelli, Terry, Stout & Kraus

[57] ABSTRACT

An amorphous core/coil assembling apparatus which prevents or minimizes damage to an amorphous core of an amorphous material upon insertion of the amorphous core into a pair of coils and which is high in reliability and superior in operability. An amorphous core of an inverted U-shape is first fixed at a predetermined position, and then a coil receiving table on which a pair of coils are placed is guided to a position at which end portions of the legs of the U-shape of the amorphous core are positioned in the proximity of a pair of V-shaped openable and closeable guide caps, whereafter the guide caps are removed from the end portions of the legs of the amorphous core.

4 Claims, 15 Drawing Sheets

AMORPHOS CORE/COIL ASSEMBLING APPARATUS

BACKGROUND OF THE INVENTION

1. Field of the Invention

This invention relates to an assembling apparatus for a transformer, and more particularly to an amorphous metal core (hereinafter amorphous core)/coil assembling apparatus for inserting an amorphous core into a pair of coils to assemble them.

2. Description of the Related Art

In recent years, attention has been paid to transformers which employ a laminated amorphous core. In manufacturing such transformers, great care is required in handling such an amorphous core because of brittleness after annealing due to a characteristic of an amorphous metal.

A process of assembling an amorphous core of the type mentioned and a coil is disclosed, for example, in Japanese Patent Laid-Open Application No. 63-501607 wherein, as shown in FIG. 10, an amorphous core 21 formed in a substantially U-shaped profile from a layered amorphous material is first held and secured at inner and outer faces of a pair of legs and an interconnection portion thereof between the legs using a holding unit 23 and then moved in the direction indicated by an arrow mark D along a pair of chutes 24 provided for end portions of the legs of the amorphous core 21 to insert the legs into center holes of a pair of coils 22, whereafter the chutes 24 are removed and the holding unit 23 is removed to release the amorphous core 21 therefrom.

The Prior Art described above has a disadvantage in operability upon insertion of the amorphous core into the coil in that, when the chutes 24 are removed, the brittle material of the amorphous core 21 may be damaged, e.g., cracked or broken, by frictional contact between the chutes 24 and an end portion of the amorphous core 21.

In the process of reaching the Present Invention, the Inventors considered an idea of an assembling process as illustrated in FIGS. 9(*a*) to 9(*e*), wherein a pair of caps 8 are first fitted at end portions of a pair of legs of the U-shape of an amorphous core 1, and then the legs of the amorphous core 1 are inserted into a pair of coils 2, whereafter the caps 8 are removed.

However, there still remains the problem that fragments of the brittle amorphous core are produced when the cap 8 is removed by frictional contact between the cap 8 and an end portion of the amorphous core 1. Further, it has been found that, in order to prevent or minimize unexpected movement of the legs of the amorphous core or dispersion of the legs of amorphous cores, it is preferable to fix the amorphous core 1 while the coil 2 is moved in the direction indicated by an arrow mark U in FIGS. 9(*b*) and 9(*c*).

SUMMARY OF THE INVENTION

It is an object of the present invention to provide an amorphous core/coil assembling apparatus which prevents or minimizes damage to and unexpected movement of the legs of a U-shaped amorphous core upon insertion of the legs into a pair of coils, and which is high in reliability and superior in operability.

In order to attain the object described above, according to the present invention, there is provided an amorphous core/coil assembling apparatus, for inserting end portions of a pair of legs of an amorphous core, formed from a layered amorphous material and having a substantially U-shaped profile, into a pair of coils to assemble them, which comprises a pair of movement guide members each having an openable and closeable V-shaped cross section, fixation means for fixing the amorphous core at a predetermined position, positioning means for moving the movable guide means to the predetermined position of the amorphous core and guiding the movable guide means such that the V-shaped opposite ends of the movement guide members are opposed to the ends of the legs of the U-shape of the amorphous core, and control means for controlling operation of the movement guide members, the fixation means and the positioning means.

Preferably, the amorphous core/coil assembling apparatus further comprises a V-shape width adjustment mechanism for adjusting the V-shape width of the movement guide members to protect the ends of the legs of the amorphous core, driving means for driving the V-shaped width adjustment mechanism, a dust collection suction hole formed in a V-shaped base portion of each of the movement guide members, and a dust collector connected to the suction holes for sucking air from within the movement guide members, the control means further controlling operation of the V-shaped width adjustment mechanism, the driving means and the dust collector.

Alternatively, the movement guide members may include an adjustment mechanism for adjusting the V-shape width of the movement guide members and the dimension of the movement guide members in a direction perpendicular to the direction of the width, and driving means for driving the adjustment mechanism.

With the amorphous core/coil assembling apparatus, when the coils are moved downwardly, the movement guide members in the folded condition are inserted into the coils, and then the openings of the movement guide members are expanded. Then, after it is confirmed that the amorphous core is held by the movement guide members, the openings are closed so that the legs of the amorphous core are held and protected by the movement guide members. Consequently, unexpected movement of the legs of the amorphous core is restricted, and damage to the amorphous core is prevented. Then, the coils are moved upwardly while the amorphous core is fixed. Thereupon, the amorphous core passes through the coils while being protected by the movement guide members, and thereafter only the movement guide members are removed from the coils. If a fragment of the amorphous core or some other foreign article is produced in any of the movement guide members, then it is sucked through the suction holes formed at the bottom portions of the movement guide members by the dust collector. Consequently, a situation in which such fragment of the amorphous material or some other foreign article disperses to enter the inside of the amorphous core, or disperses to the outside, does not occur.

Accordingly, the amorphous core/coil assembling apparatus is advantageous in that, since the movement guide members guide the amorphous core so that the amorphous core may be inserted readily into the coils, unexpected movement of the amorphous core is suppressed and possible damage to the amorphous core is prevented, and also damage to the inner faces of the center holes of the coils is prevented, and besides a fragment of the amorphous material or some other foreign article is not admitted into the inside of the amorphous core. Consequently, the amorphous core/coil assembling apparatus is high in reliability and can be provided at a low cost.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
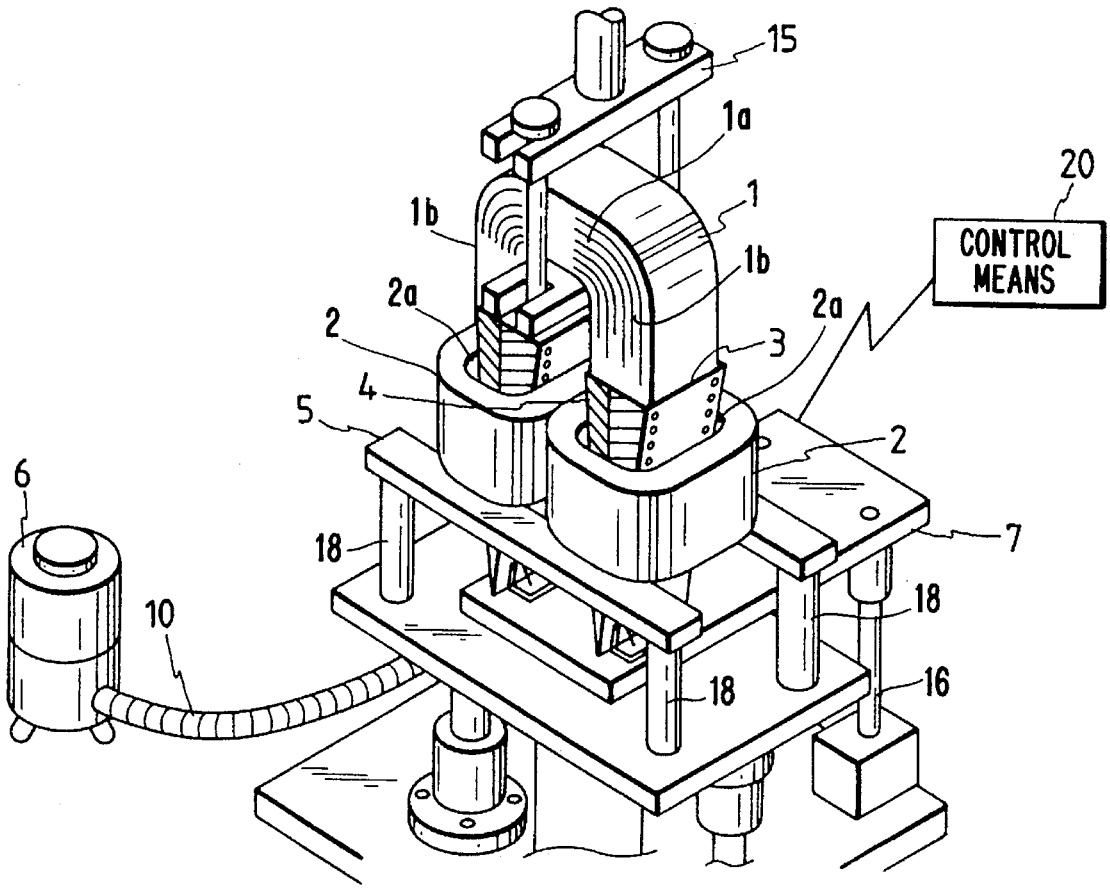
FIG. 1 is a perspective view of a main portion of an amorphous core/coil assembling apparatus of a first embodiment of the present invention.
Figure 2:
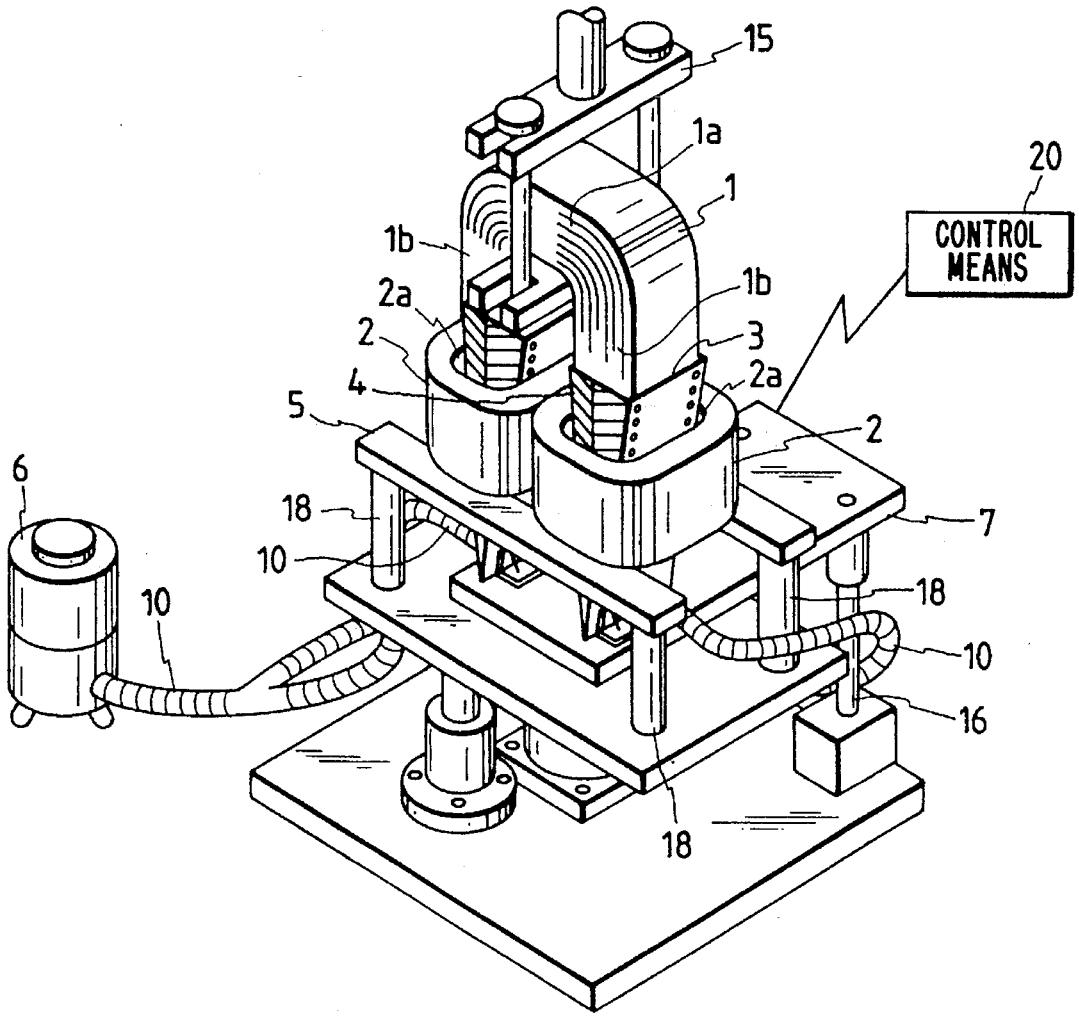
FIG. 2 is a perspective view of a specific construction of an amorphous core/coil assembling apparatus of the first embodiment of the present invention.
Figure 3A:
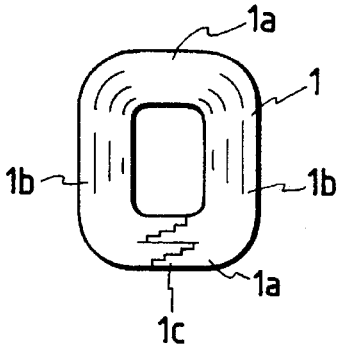
FIGS. 3(*a*) to 3(*l*) are schematic views showing different steps of an assembling process of the amorphous core assembling apparatus of the first embodiment of the present invention.
Figure 3B:
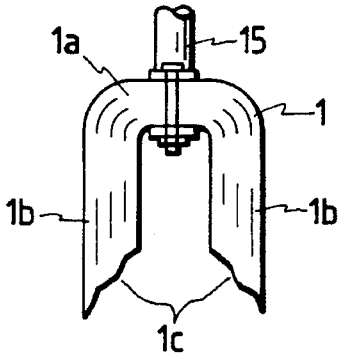
Figure 3C:
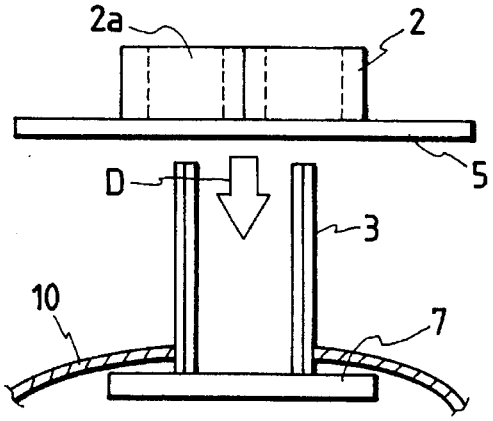
Figure 3D:
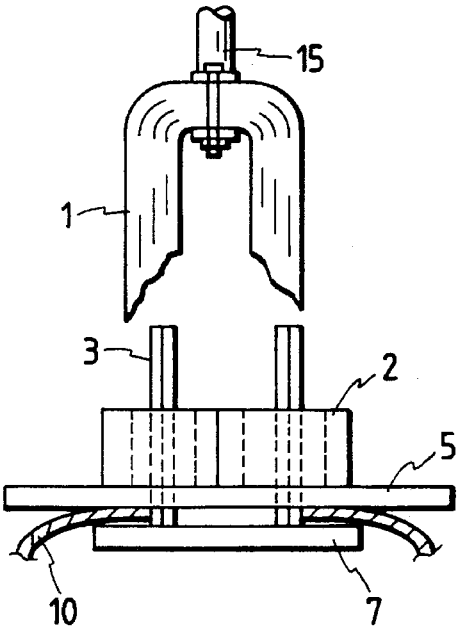
Figure 3E:
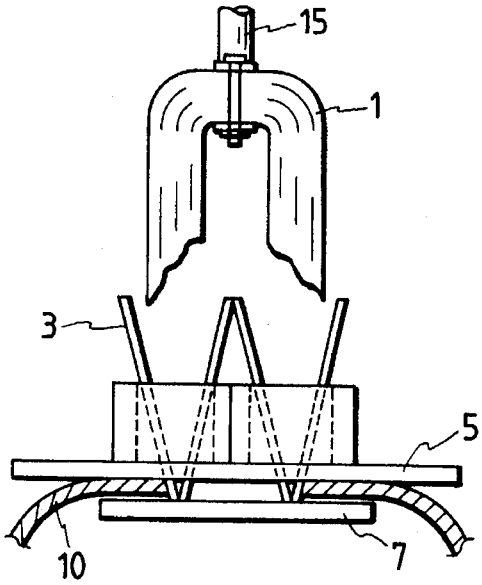
Figure 3F:
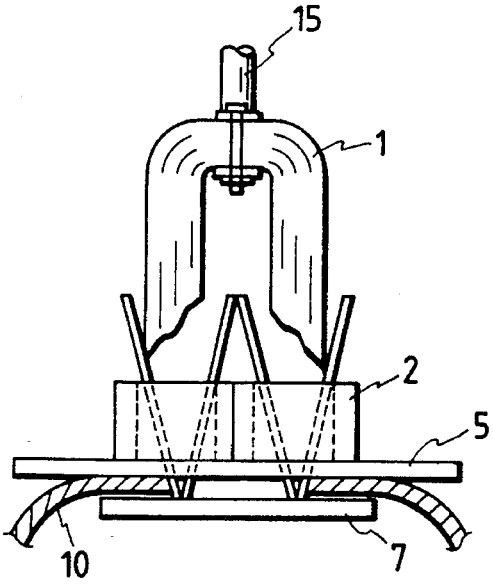
Figure 3G:
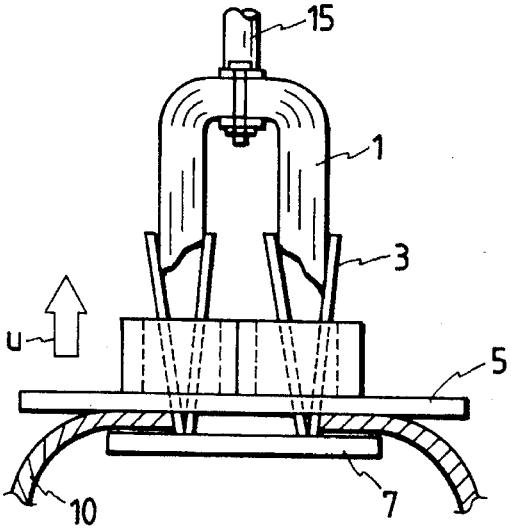
Figure 3H:
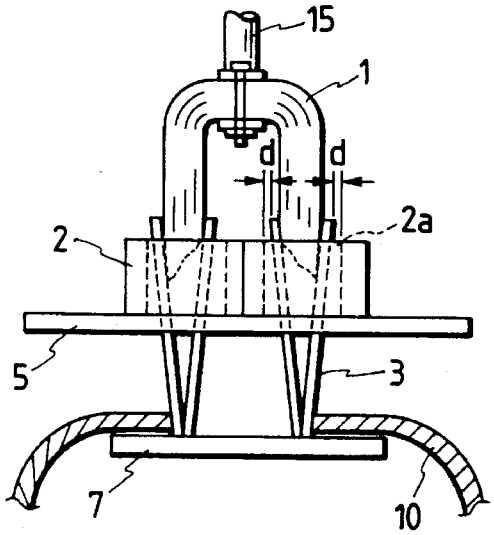
Figure 3I:
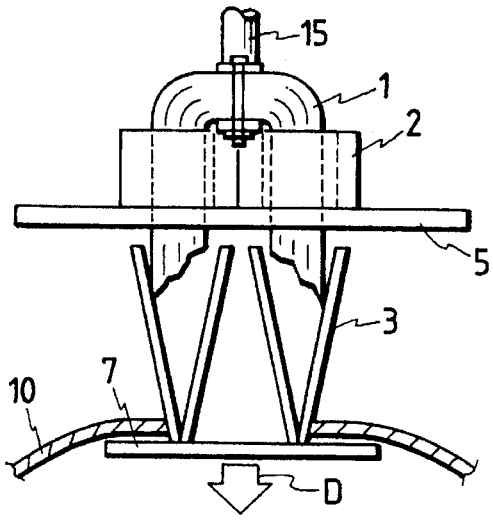
Figure 3J:
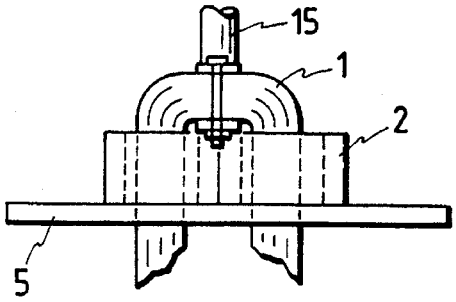
Figure 3K:
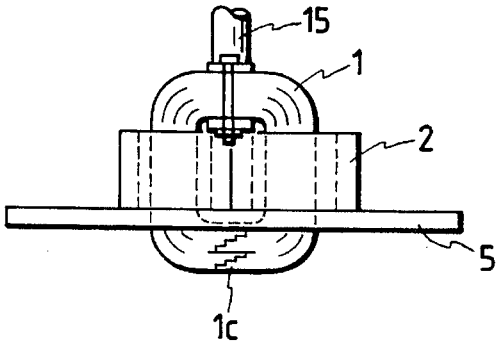
Figure 3K:
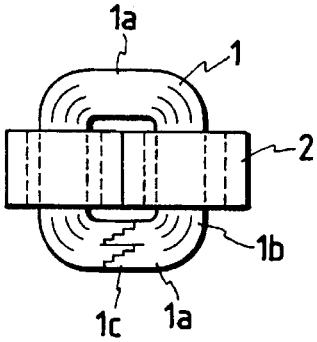
Figure 4:
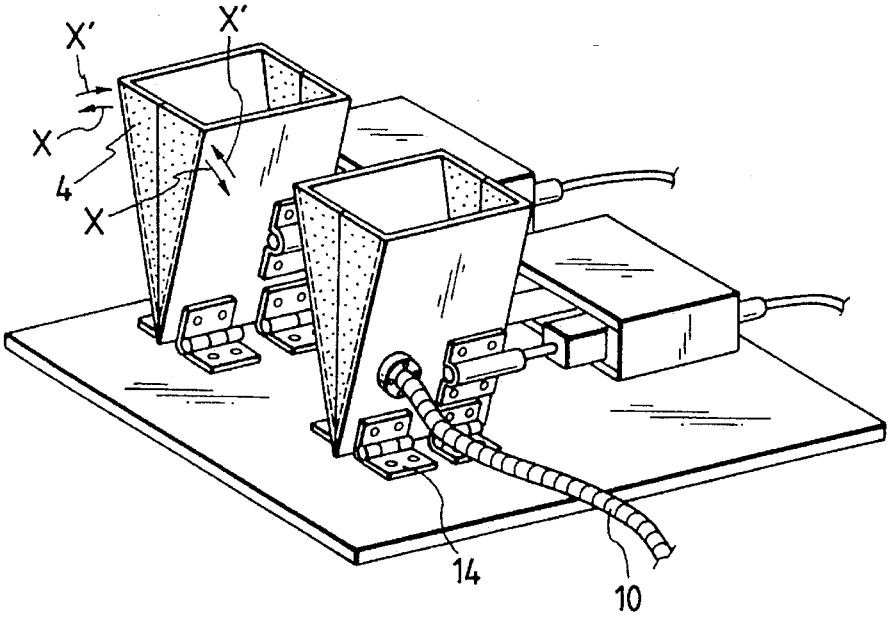
FIG. 4 is a perspective view of a guide cap employed in the amorphous core assembling apparatus of the first embodiment of the present invention.

The first embodiment of the present invention is described referring to FIGS. 1 to 4. FIG. 1 shows a main portion of the first embodiment. FIG. 2 shows a specific construction of an amorphous core/coil assembling apparatus of the first embodiment. The amorphous core 1 is manufactured by the method e.g. disclosed in U.S. Pat. No. 5,261,152, i.e. manufactured by piling up laminated blocks of thin amorphous metal sheets on a rectangular mandrel and by forming the blocks into a rectangular shape along the mandrel using rectangularly forming device, and then annealing the rectangularly formed core in an annealing device to stabilize the magnetic character. The amorphous core 1 has two yokes 1*a* (only upper one of the yokes 1*a* is visible in FIGS. 1 and 2) and two legs 1*b*. A joint 1*c* is formed in one of the yokes 1*a* (not visible in FIGS. 1 and 2), where the amorphous core 1 is opened in order to insert the legs 1*b* into each center hole 2*a* of a pair of coils 2 formed from conductors (not illustrated) wound on themselves.

The amorphous core/coil assembling apparatus shown is constructed to insert the legs 1*b* of an amorphous core 1 into the center holes 2*a* of the coils 2. The amorphous core/coil assembling apparatus in this embodiment includes a yoke holder 15, a coil mount 5 disposed under the yoke holder 15, a pair of foldable guide caps 3 mounted on a guide cap mount 7 and disposed under the legs 1*b*, a dust-collector 6 with a hose 10 connected to the bottom portion of the guide caps 3.

The yoke holder 15 is disposed movable so as to carry the amorphous core 1 from the position where the amorphous core 1 is prepared to a position just above the coil mount 5. The yoke holder 15 holds the yoke 1*a* without the joint 1*c* fixedly, so as to hang the amorphous core 1 with the joint 1*c* downward. In order to insert the amorphous core 1 into the coils 2, the joint 1*c* is released and the amorphous core 1 is formed into an upside-down U shape. The amorphous core 1 can easily be formed into an upside-down U shape by gravity, as each amorphous metal sheet in the laminated block is very thin and more flexible than an ordinary electromagnetic steel sheet even though it is brittle. The guide cap mount 7 is disposed so as to move up and down. This up-and-down movement is performed by guide cap mount lifting means 16, such as cylinders using oil pressure or air pressure, or such as linear actuators using electric power. A pair of foldable guide caps 3 are mounted on the guide cap mount 7, each of which can be opened to a position where it presents a V-shape profile in side elevation. A pair of flexible members 4 extend between opposite side ends of each of the guide caps 3 to allow the V-shaped openings of the guide cap 3 to be increased in the direction indicated by arrow marks X or decreased in the direction indicated by arrow marks X' in FIG. 4. Normally, each of the guide caps 3 is in a condition folded in the direction of the arrow marks X' such that it presents a flattened condition. The flexible members 4 are made of bellows or cloth.

The coil mount 5 is disposed so as to move up and down along the guide caps 3. This up-and-down movement is performed by coil mount lifting means 18, such as cylinders using oil pressure or air pressure.

The amorphous core/coil assembling apparatus further includes the dust collector 6 including the hose 10 having an end connected to bottom portions of the guide caps 3, so that if a small fragment of the layered amorphous material of the amorphous core 1 drops to the bottom portion of any of the guide caps 3, it may be immediately sucked and collected in the dust collector 6. The guide caps 3 are securely supported at bottom portions thereof to the guide cap mount 7.

The guide cap 3, the guide cap mount 7, the coil mount 5 and the yoke holder 15 are controlled by a control means 20. Usually a programmable controller, a personal computer or the like is used as the control means 20.

FIGS. 3(*a*) to 3(*l*) show steps of an assembling process performed by the amorphous core/coil assembling apparatus. The control means 20 controls the coil mount 5, the guide cap 3, the guide cap mount 7 and the yoke holder 15 in following steps.

Step 001: First the annealed amorphous core 1 is prepared (FIG. 3(*a*)).

Step 002: Upper yoke 1*a* is fixed by the yoke holder 15, and the joint 1*c* is released to form an upside-down U shape (FIG. 3(*b*)).

Step 003: The guide cap mount 7 is fixed at a predetermined position. First the coil mount 5 is disposed over the guide cap 3 and coils 2 are mounted thereon. Then the coil mount 5 moves down as indicated by an arrow mark D to insert the guide caps 3 into center holes 2*a* of the coils 2. The guide caps 3 are in their folded condition with the top ends thereof closed (FIG. 3(*c*)).

Step 004: After insertion of the guide caps 3 into the coils 2, the yoke holder 15 carries the amorphous core 1 to a position just above the coil mount 5, where the yoke holder 15 fixes the amorphous core 1 till the insertion of the coils is over (FIG. 3(*d*)).

Step 005: The guide caps 3 are opened into a V-shape to enable the insertion of the legs 1*b* of the amorphous core 1. (FIG. 3(*e*)).

Step 006: The guide cap mount 7 goes up with the coil mount 5 to a position where the open ends of the guide caps 3 contact lightly with the lower ends of the legs 1*b*, and then the guide caps 3 start moving in the closing direction to decrease the width of the V-shape (FIG. 3(*f*)).

Step 007: The guide caps 3 fix the legs 1*b* of the amorphous core 1 by the open ends of the guide caps 3. Then the coil mount 5 starts moving upwardly as indicated by an arrow mark U (FIG. 3(*g*)).

Step 008: Upon such upward movement of the coil mount 5, a gap d, formed between an outer profile of the V-shaped guide caps 3 and an inner surface of each coil 2, is controlled so as to prevent a scratch on the inner surfaces of the coils 2 by adjusting the V-shape width of the guide caps 3(FIG. 3(*h*)).

Step 009: The coil mount 5 further moves upwardly and then stops when the coils 2 come to a predetermined position relative to the amorphous core 1. After the coil mount 5 is stopped, the guide caps 3 stop fixing the legs 1*b*, and the guide cap mount 7 moves downwardly as indicated by an arrow mark D (FIG. 3(*i*)).

Step 010: The coil mount 5 remains at the predetermined position so as to enable coupling the joint 1*c*. (FIG. 3(*j*)).

Step 011: The joint is coupled, and the outer periphery of the amorphous core 1 is fixed with steel bands or the like (FIG. 3(*k*)).

Step 012: The yoke holder 15 is released and detached from the upper yoke 1*a*. The amorphous core/coil assembly process is over (FIG. 3(*l*)).

In this embodiment, as the yoke holder 15 fixes the amorphous core 1 till the insertion of the coils is over at a position just above the coil mount 5, and as the coils 2 mounted on the coil mount 5 move upwardly, with the lower end of the legs 1*b* being held and fixed by the guide caps 3, undesirable movement of the legs 1*b* can be prevented effectively. Consequently, amorphous core/coil assembly can be performed keeping the stable condition of the amorphous core 1. The characteristic just described similarly applies to a second preferred embodiment of the present invention described below.

Figure 5:
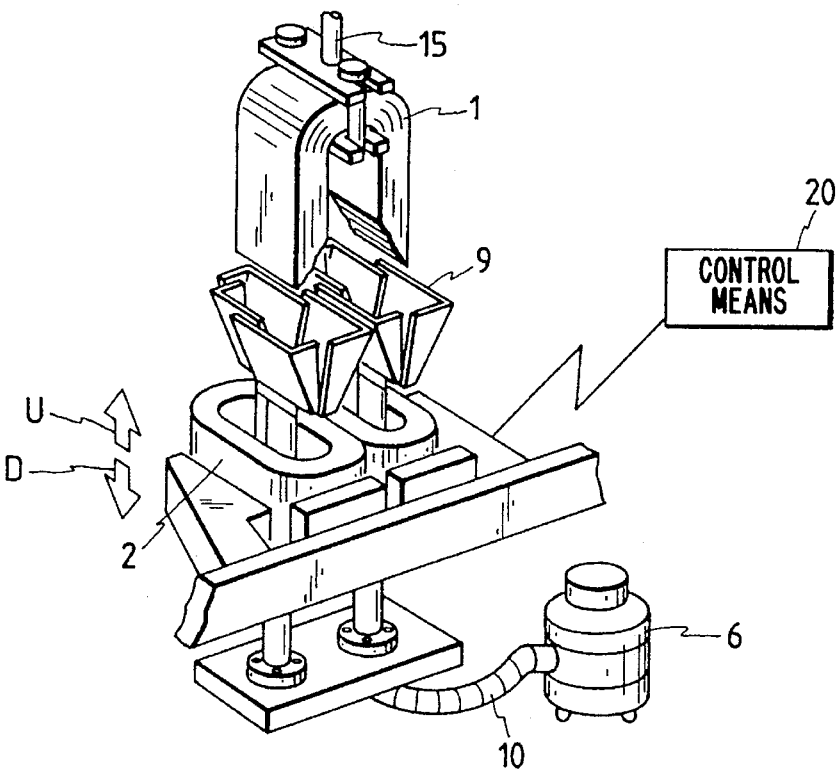
FIG. 5 is a perspective view of an amorphous core/coil assembling apparatus of a second embodiment of the present invention.
Figure 6:
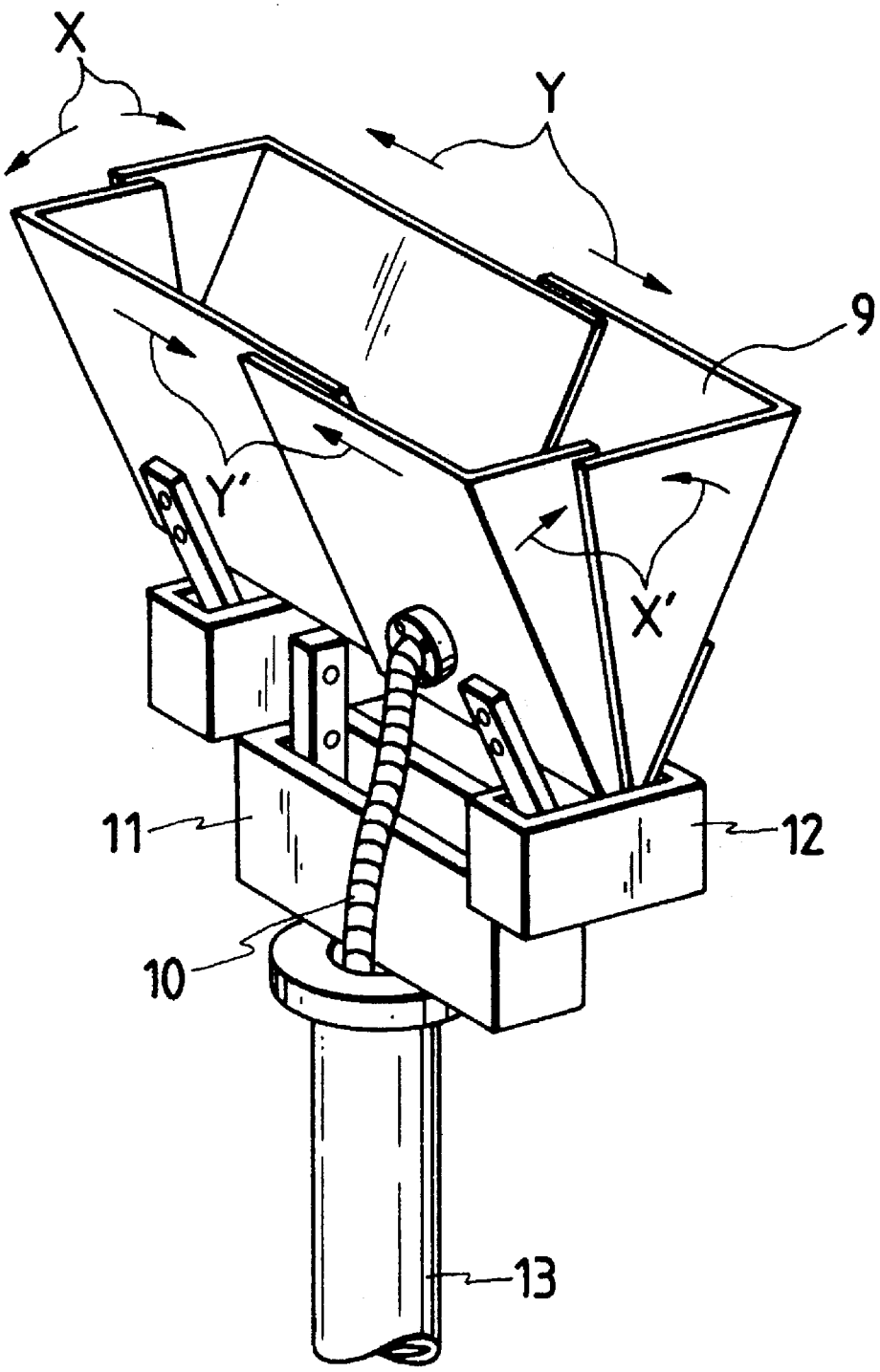
FIG. 6 is a perspective view showing a guide bucket employed in the amorphous core/coil assembling apparatus of the second embodiment of the present invention.

The second embodiment of the present invention is described referring to FIGS. 5 and 6. Referring now to FIGS. 5 and 6, there is shown another amorphous core/coil assembling apparatus to which the present invention is applied. This embodiment is a modification of that of the first embodiment. This embodiment is different from the first embodiment in that it includes a pair of guide buckets 9 in place of the guide caps 3 and a pair of support posts 13, each supporting a guide bucket 9, in place of the guide cap mount 7 of the first embodiment. As for the other components of the apparatus, the same components as the first embodiment are used.

Each of the guide buckets 9 is provided for guiding and covering an end portion of one of the two legs 1*b* and is formed from several elements which are movable in the directions indicated by arrow marks X and X' and by arrow marks Y and Y' relative to each other as seen in FIG. 6 so that the width of the V-shaped opening thereof can be adjusted in accordance with the width of an amorphous core 1. The adjustment of the guide bucket 9 in the direction of the arrow mark X or X' is performed by means of an air chuck 12 while the adjustment in the direction of the arrow mark Y or Y' is performed by means of a linear actuator 11 mounted on a support post 13. The support post 13 is disposed to move up and down. This up-and-down movement is performed by a cylinder, using oil pressure or air pressure, or by a linear actuator, using electric power.

The amorphous core/coil assembling apparatus operates in a similar manner to that of the first embodiment described above to assemble the amorphous core 1 and the coils 2. The control means 20 controls the coil mount 5, the guide buckets 9, the guide cap mount 7 and the yoke holder 15 in following steps just like those shown in FIGS. 3(*a*) to 3(*l*).

Step 001: First the annealed amorphous core 1 is prepared (FIG. 3(*a*)).

Step 002: Upper yoke 1*a* is fixed by the yoke holder 15, and the joint 1*c* is released to form an upside-down U shape (FIG. 3(*b*)).

Step 003: The support posts 13 are fixed at a predetermined position. First the coil mount 5 is disposed over the guide buckets 9 and coils 2 are mounted thereon. Then the coil mount 5 moves down as indicated by an arrow mark D to insert the guide bucket 9 into center holes 2*a* of the coils 2. The guide buckets 9 are in their folded condition with the top ends thereof closed (FIG. 3(*c*)).

Step 004: After insertion of the guide buckets 9 into the coils 2, the yoke holder 15 carries the amorphous core 1 to a position just above the coil mount 5, where the yoke holder 15 fixes the amorphous core 1 till the insertion of the coils is over (FIG. 3(*d*)).

Step 005: The guide buckets 9 are opened into a V-shape to enable the insertion of the legs 1*b* of the amorphous core 1. (FIG. 3(*e*)).

Step 006: The support posts 13 go up with the coil mount 5 to a position where the open ends of the guide buckets 9 contact lightly with the lower ends of the legs 1*b*, and then the guide buckets 9 start moving in the closing direction to decrease the width of the V-shape (FIG. 3(*f*)).

Step 007: The guide buckets 9 fix the legs 1*b* of the amorphous core 1 by the open ends of the guide buckets 9. Then the coil mount 5 starts moving upwardly as indicated by an arrow mark U (FIG. 3(*g*)).

Step 008: Upon such upward movement of the coil mount 5, a gap d, formed between an outer profile of the V-shaped guide buckets 9 and an inner surface of each coil 2, is controlled so as to prevent a scratch on the inner surfaces of the coils 2 by adjusting the V-shape width of the guide buckets 9(FIG. 3(*h*)).

Step 009: The coil mount 5 further moves upwardly and then stops when the coils 2 come to a predetermined position relative to the amorphous core 1. After the coil mount 5 is stopped, the guide buckets 9 stop fixing the legs 1*b*, and the support posts 13 move downwardly as indicated by an arrow mark D ( FIG. 3(*i*)).

Step 010: The coil mount 5 remains at the predetermined position so as to enable coupling the joint 1*c*. (FIG. 3(*j*)).

Step 011: The joint is coupled, and the outer periphery of the amorphous core 1 is fixed with steel bands or the like (FIG. 3(*k*)).

Step 012: The yoke holder 15 is released and detached from the upper yoke 1*a*. The amorphous core/coil assembly process is over (FIG. 3(*l*)).

In the second embodiment, as dimensions of the guide bucket 9 are adjustable in either directions of the arrow mark X , X' or of the arrow mark Y, Y', the apparatus can be easily applied to different sizes of amorphous cores. This apparatus is very convenient for multi-type small quantity manufacturing.

In the amorphous core/coil assembling apparatus of the first and second embodiments described above, when the amorphous core 1 is inserted into the center holes of the coils 2, the guide caps 3 or the guide buckets 9 are opened by a great amount to facilitate insertion of the legs of the amorphous core 1, but after such insertion, the guide caps 3 or the guide buckets 9 are closed to protect the legs of the amorphous core 1. This is very effective to prevent undesirable movement of the legs of the amorphous core 1, while possible damage to the amorphous material of the amorphous core 1 is prevented or minimized. Further, even if a fragment of the amorphous material or some other foreign article is produced, since it is sucked by the dust collector 6 from the bottom portions of the guide caps 3 or the guide buckets 9 while the legs of the amorphous core 1 are at a lowered position, admission of the same into the inside of the amorphous core 1 is prevented. Further, due to the presence of the gap d provided between the inner face of the hole 2*a* of each of the coils 2 and an opposing outer face of a corresponding one of the guide caps 3 or the guide buckets 9, the inner faces of the coils are not damaged. Thus, the legs of the amorphous core 1 are protected with a comparatively simple structure, and consequently the cost of the entire amorphous core/coil assembling apparatus is held down.

Figure 7:
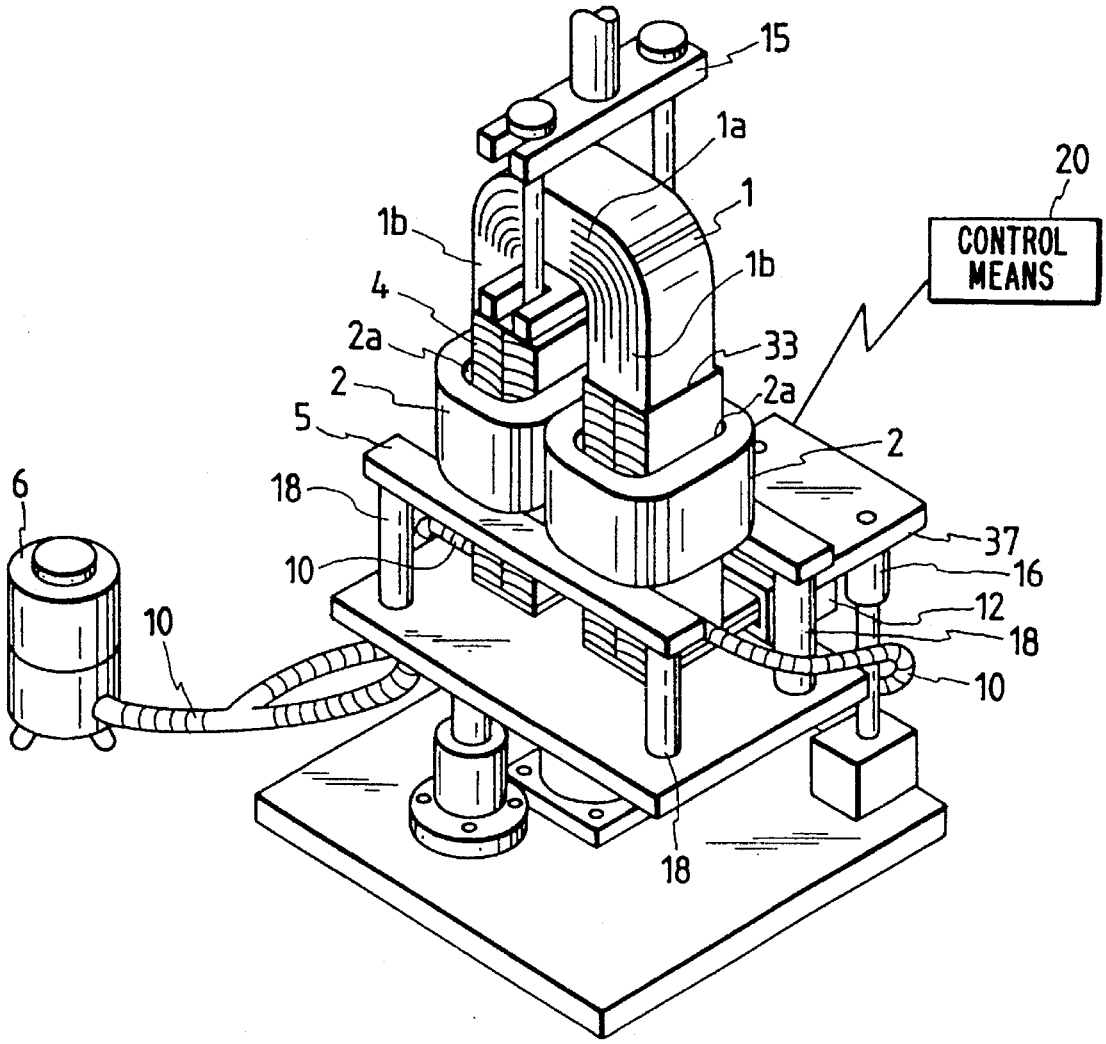
FIG. 7 is a perspective view of a specific construction of an amorphous core/coil assembling apparatus of a third embodiment of the present invention.
Figure 8A:
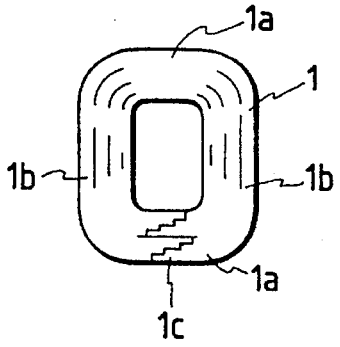
FIGS. 8(*a*) to 8(*l*) are schematic views showing different steps of an assembling process of the amorphous core assembling apparatus of the third embodiment of the present invention.
Figure 8B:
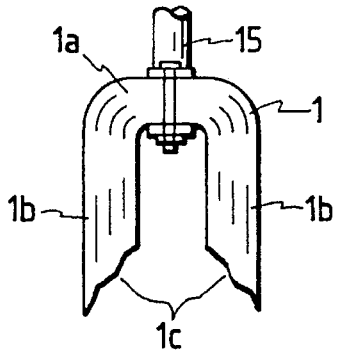
Figure 8C:
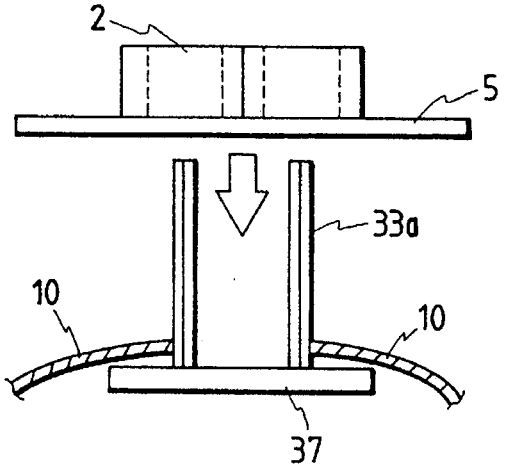
Figure 8D:
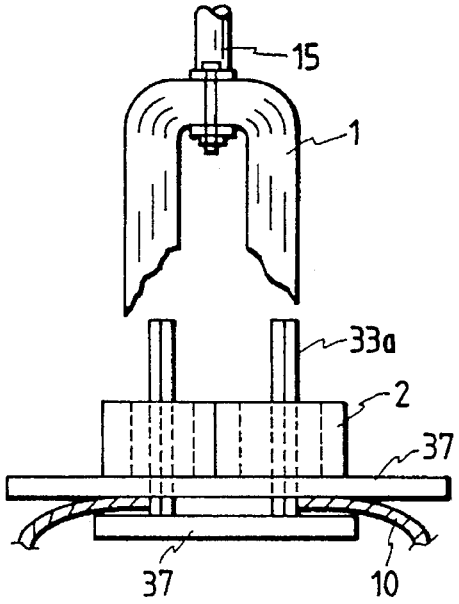
Figure 8E:
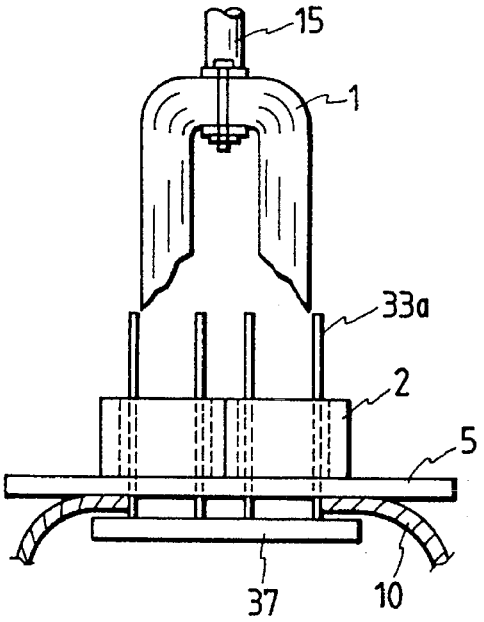
Figure 8F:
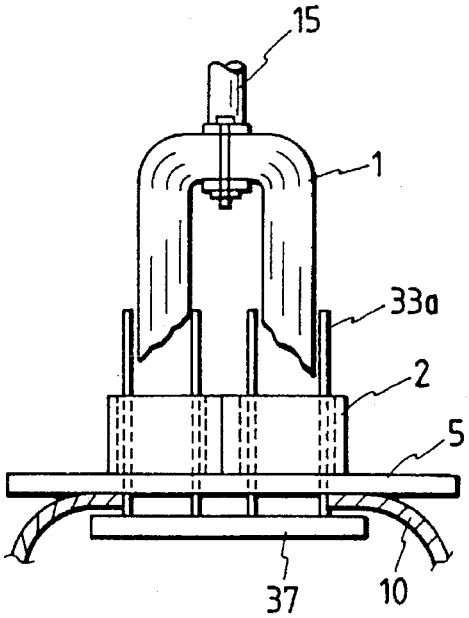
Figure 8G:
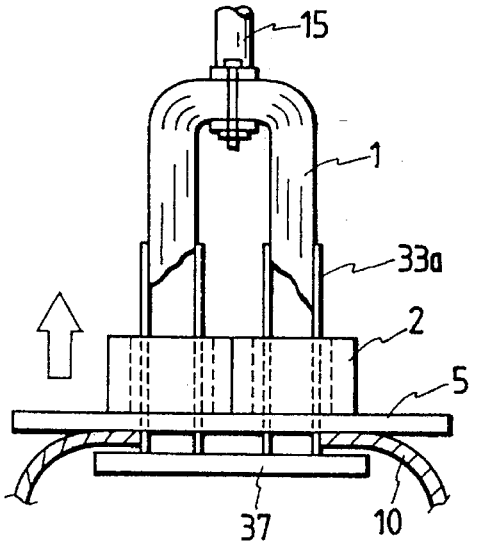
Figure 8H:
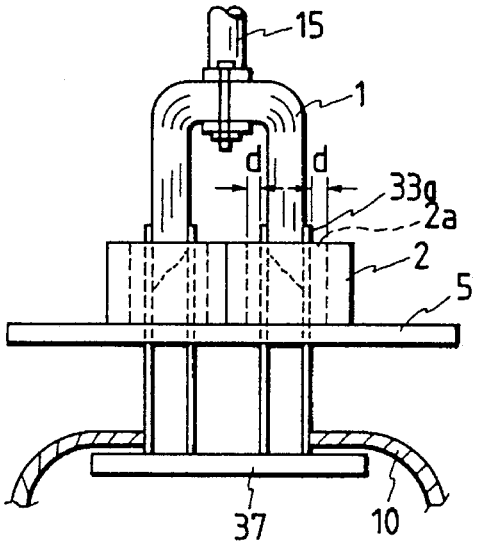
Figure 8I:
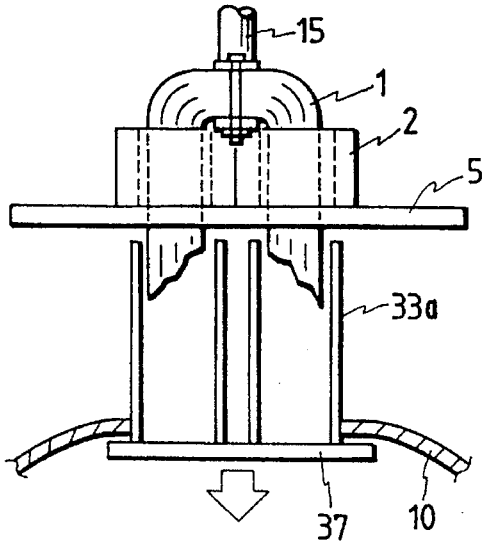
Figure 8J:
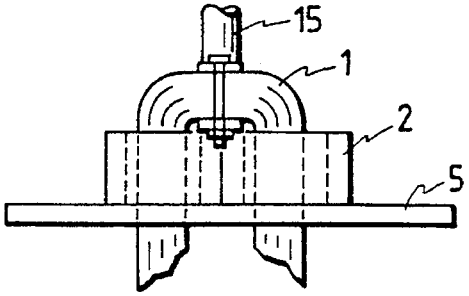
Figure 8K:
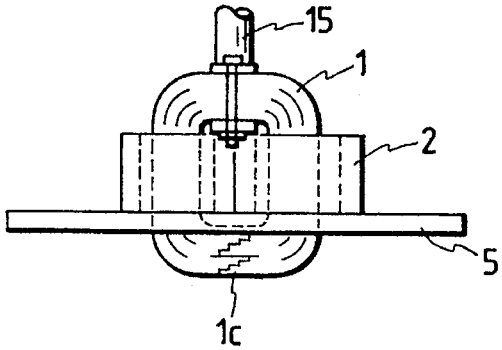
Figure 8K:
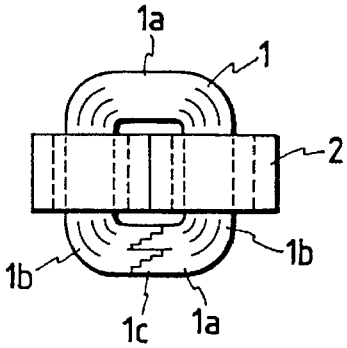
Figure 9A:
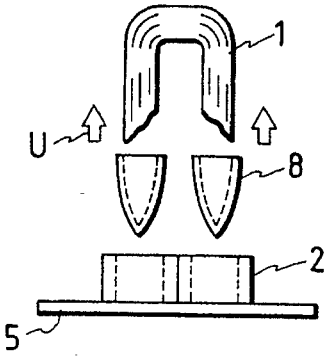
FIGS. 9(*a*) to 9(*e*) are schematic views showing an assembling process from which a conception to the present invention has been obtained.
Figure 9B:
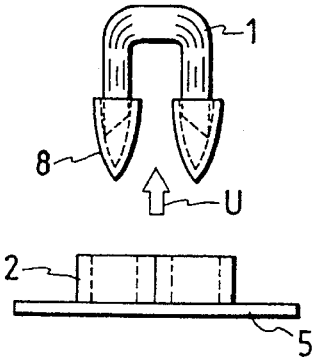
Figure 9C:
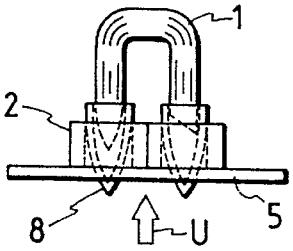
Figure 9D:
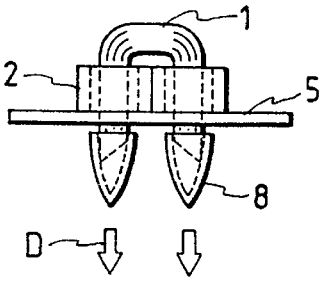
Figure 9E:
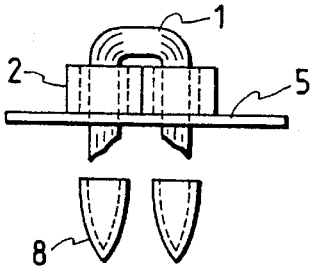
Figure 10:
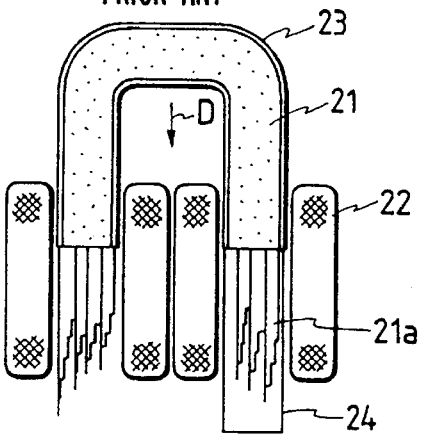
FIG. 10 PRIOR ART
FIG. 10 is a schematic view showing an amorphous core inserted in a coil in accordance with a conventional amorphous core/coil assembling process.

The third embodiment of the present invention is described referring to FIGS. 7 and 8. Referring now to FIGS. 7 and 8, there is shown another amorphous core/coil assembling apparatus to which the present invention is applied. This embodiment is also a modification to that of the first embodiment. This embodiment is different from the first embodiment in that it includes a pair of clamping boxes 33 in place of the guide caps 3 and a clamping box mount 37 in place of the guide cap mount 7 of the first embodiment. As for the other components of the apparatus, the same components as the first embodiment are used.

Each of the clamping boxes 33 is provided for guiding and covering an end portion of one of the two legs 1*b*. Each clamping box 33 is formed from a pair of foldable flexible members 4 and a pair of rigid guide boards 33*a* which are movable horizontally in the opposite directions as seen in FIG. 8(*c*) to 8(*i*) so that the width of the clamping box 33 can be adjusted in accordance with the width of the amorphous core 1. The adjustment of the width of the clamping box 33 in the horizontal direction is performed by means of an air chuck 12 installed in the clamping box mount 37.

The hose 10 is also connected to bottom portions of the clamping box 33 so that a small fragment of amorphous metal sheet may be immediately sucked and collected in the dust collector 6.

The amorphous core/coil assembling apparatus operates in a similar manner to that of the first embodiment described above to assemble the amorphous core 1 and the coils 2. The control means 20 controls the coil mount 5, the clamping boxes 33, the clamping box mount 37 and the yoke holder 15 in following steps shown in FIGS. 8(*a*) to 8(*l*).

Step 001: First the annealed amorphous core 1 is prepared (FIG. 8(*a*)).

Step 002: Upper yoke 1*a* is fixed by the yoke holder 15, and the joint 1*c* is released to form an upside-down U shape (FIG. 8(*b*)).

Step 003: The clamping box mount 37 is fixed at a predetermined position. First the coil mount 5 is disposed over the clamping boxes 33 and coils 2 are mounted thereon. Then the coil mount 5 moves down as indicated by an arrow mark D to insert the clamping boxes 33 into center holes 2*a* of the coils 2. The clamping boxes 33 are in their closed condition with the top ends thereof closed (FIG. 8(*c*)).

Step 004: After insertion of the clamping boxes 33 into the coils 2, the yoke holder 15 carries the amorphous core 1 to a position just above the coil mount 5, where the yoke holder 15 fixes the amorphous core 1 till the insertion of the coils is over (FIG. 8(*d*)).

Step 005: The clamping boxes 33 are opened with their rectangular openings facing the released joints 1*c* to enable the insertion of the legs 1*b* of the amorphous core 1. (FIG. 8(*e*)).

Step 006: The clamping box mount 37 goes up with the coil mount 5 to a position where the openings of the clamping boxes 33 contact lightly with the lower ends of the legs 1*b*, and then the clamping boxes 33 start moving in the closing direction to decrease the width of the openings (FIG. 8(f)).

Step 007: The clamping boxes 33 fix the legs 1*b* of the amorphous core 1 by the open ends of the clamping boxes 33. Then the coil mount 5 starts moving upwardly as indicated by an arrow mark U (FIG. 8(*g*)).

Step 008: Upon such upward movement of the coil mount 5, a gap d, formed between an outer profile of the clamping boxes 33 and an inner surface of each coil 2, is controlled so as to prevent a scratch on the inner surfaces of the coils 2 by adjusting the width of the clamping boxes 33(FIG. 8(*h*)).

Step 009: The coil mount 5 further moves upwardly and then stops when the coils 2 come to a predetermined position relative to the amorphous core 1. After the coil mount 5 is stopped, the clamping boxes 33 stop fixing the legs 1*b*, and the clamping box mount 37 moves downwardly as indicated by an arrow mark D (FIG. 8(*i*)).

Step 010: The coil mount 5 remains at the predetermined position so as to enable coupling the joint 1*c*. (FIG. 8(*j*)).

Step 011: The joint is coupled and the outer periphery of the amorphous core 1 is fixed with steel bands or the like (FIG. 8(*k*)).

Step 012: The yoke holder 15 is released and detached from the upper yoke 1*a*. The amorphous core/coil assembly process is over (FIG. 8(*l*)).

Figure 11:
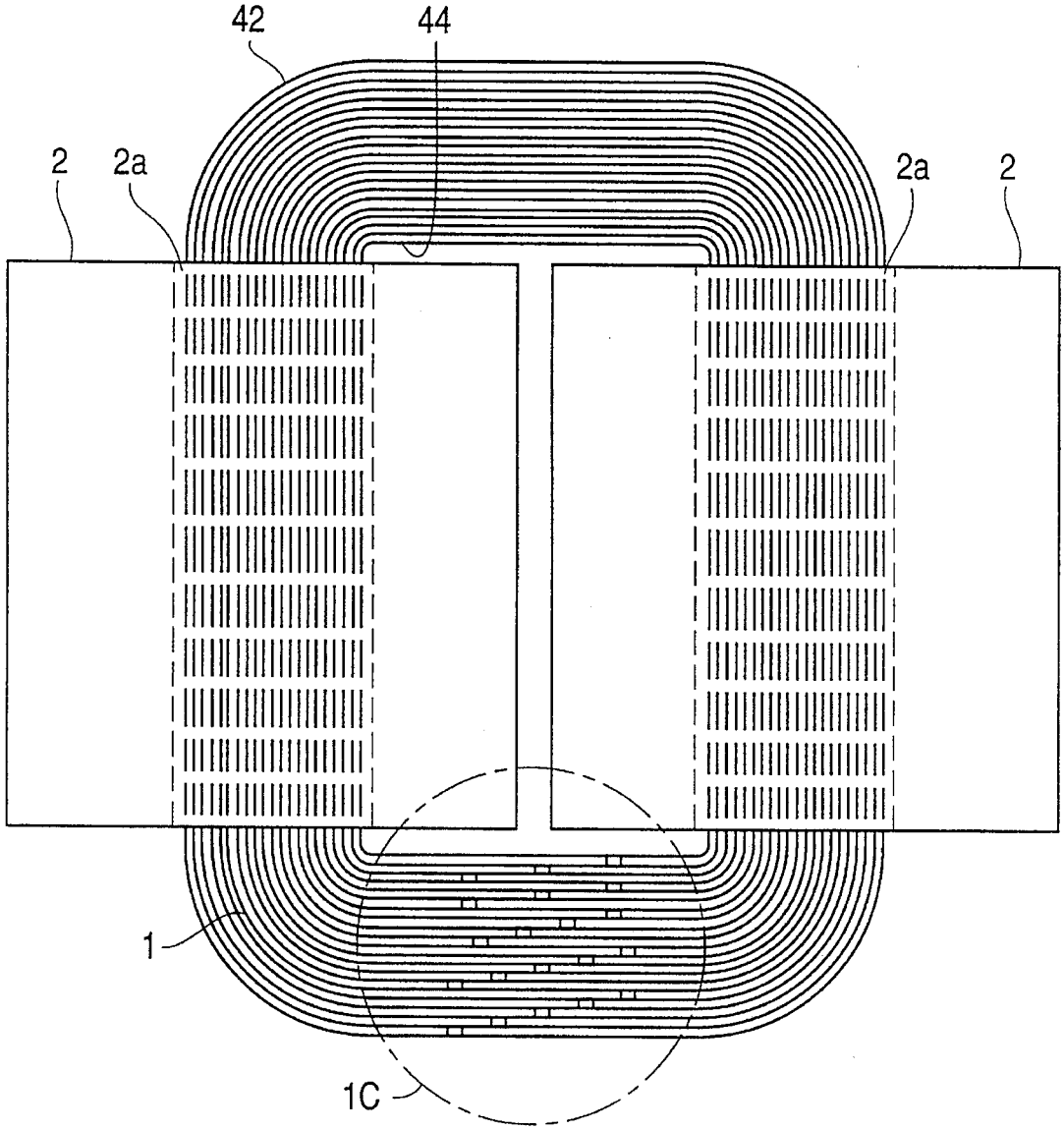
FIG. 11 is a side elevational view of an amorphous core assembled by the apparatus of the present invention.
Figure 12:
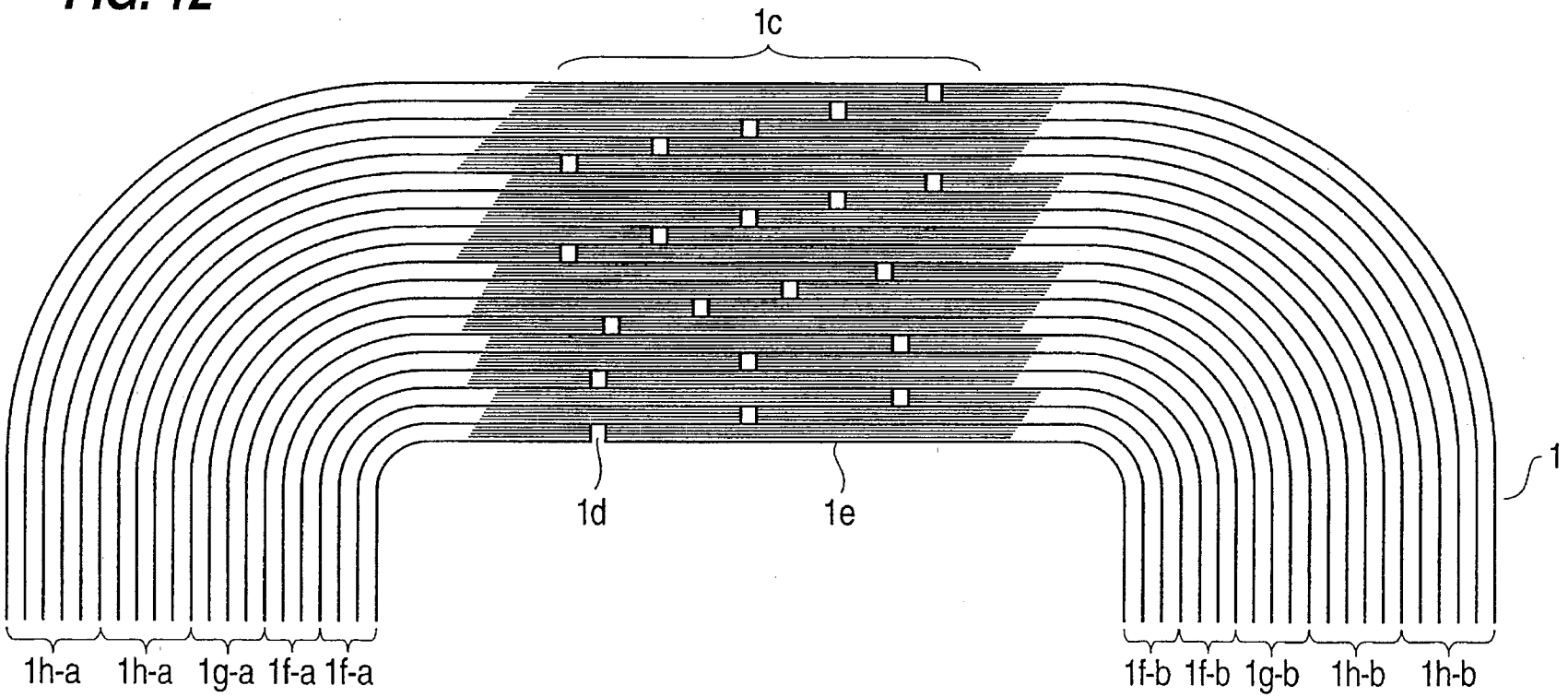
FIG. 12 is a side elevational view of a joint portion of an amorphous core assembled by the apparatus of the present invention.
Figure 13:
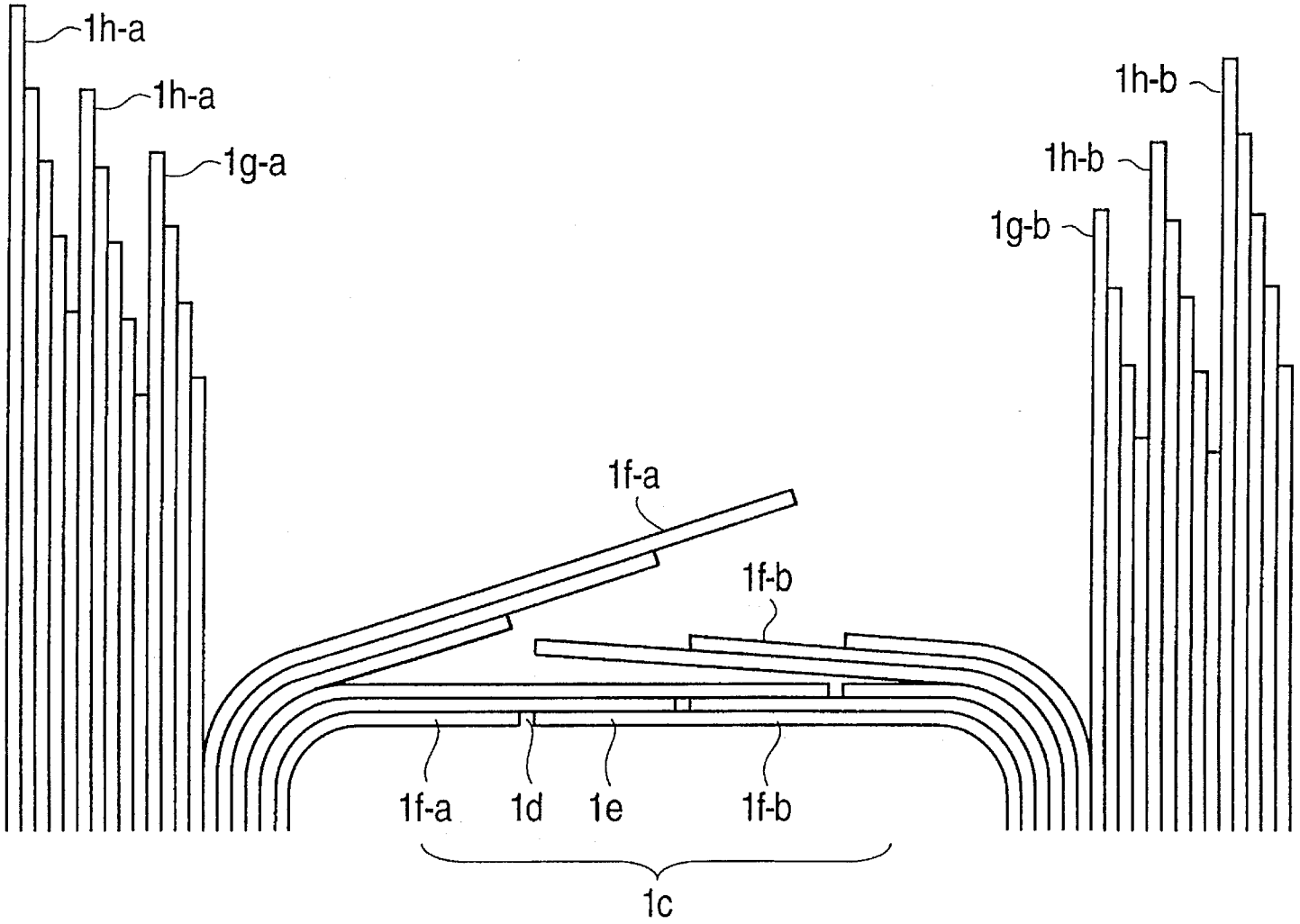
FIG. 13 is a side elevational view of the joint portion of the amorphous core in the assembling process.

It is to be noted that the guide caps 3 in the first embodiment, the guide buckets 9 in the second embodiment and the clamping box 33 in the third embodiment serve as a clamping means; the yoke holder 15 serves as fixation means for fixing the amorphous core at a predetermined position; the coil mount 5, the guide cap mount 7 in the first embodiment, the support shaft 13 in the second embodiment and clamping box mount 37 in the third embodiment, and the driving apparatus for them serve as positioning means; and the entire mechanism, including the positioning means, the movement guide member and the dust collector 6, serves as a mechanism section. Further, the flexible members in the first embodiment serve as a V-shape width adjustment mechanism; the air chucks 12 serve as driving means for the V-shaped width adjustment mechanism; the guide buckets 9 in the second embodiment serve as an adjustment mechanism for adjusting the V-shape width of the movement guide member and the dimension in a direction perpendicular to the direction of the V-shaped width; and the linear actuator 11 and the air chucks 12 serve as driving means for the adjustment mechanism. An embodiment of an amorphous core/coil assembly manufactured by an apparatus of above embodiments is illustrated in FIGS. 11, 12, and 13. As illustrated in FIG. 11, the amorphous core 1 has a joint portion 1*c* in one of the yokes. In order to maintain a rectangular shape, thin ferro-magnetic steel sheets 42 and 44 (not shown in FIGS. 12 and 13) are wound respectively on the outer periphery and inner periphery of the amorphous core 1. As illustrated in FIG. 12, a plurality of thin amorphous sheet (10–20 sheets) are piled up into a laminated blocks 1*e*, and plurality of the laminated blocks 1*e* are piled up into units 1*f*, 1*g* and 1*h*. Ends of block 1*e* in each unit are disposed so as to form a butted joint with a gap 1*d* in the joint portion 1*c*. Positions of the gap 1*d* are displaced stepwise in each unit, so as to enable upper half of each unit 1*f-a*, 1*g-a* and 1*h-a* to be piled up on the lower half of each unit 1*f-b*, 1*g-b* and 1*h-b* easily as illustrated in FIG. 13. The number of the blocks contained in an outer unit is greater than that in an inner unit, as the straight portion of the yoke is longer in the outer unit. The number of the blocks contained in the unit is preferably not less than 3, in order to prevent a magnetic flux from concentrating at adjacent gaps in the adjacent unit. The length of the gap 1*d* is 0 - several millimeters, and the distance between the gaps is respectively 15–30 millimeters in inner units and several - 15 millimeters in outer units. In this embodiment, since all of the laminated blocks 1*e* are kept straight after joint portion 1*c* is closed as shown in FIG. 12, no stress is applied to the joint portion, which reduces generation of amorphous metal fragment to improve the reliability of the transformer. (In case of a lap joint as disclosed in the prior art, e.g. Japanese Patent Laid-Open Application No. 63-501607, one end of a laminated block is butted to a inner side portion near the other end of the laminated block, where stress is applied to the butted portion, which causes generation of amorphous metal fragments.)

As described above, in order to reduce amorphous metal fragments, it is better to use the apparatus of this Invention for assembling such an amorphous core/coil assembly which includes an amorphous core having a pair of yokes and a pair of legs and having a joint portion in one of said yokes and a coil having an opening for inserting said leg, where the amorphous core having a plurality of laminated blocks of thin amorphous sheets which are piled up into plurality of units, and the joint portion forming a butted joint with gaps whose positions are displaced stepwise in each unit.

This Invention may also be applied to manufacturing such a reactor as has a rectangular amorphous core and a coil inserted into one of the legs of the rectangular core.

Having now fully described the invention, it will be apparent to one of ordinary skill in the art that many changes and modifications can be made thereto without departing from the spirit and scope of the invention as set forth herein.

What is claimed is:

1. An amorphous core/coil assembling apparatus for manufacturing an amorphous core/coil assembly by inserting an amorphous core into a coil having an opening, said apparatus comprising:

fixation means for holding an amorphous core of an upside-down U shape at a predetermined position;

coil holding means for holding a coil having an opening at a position facing the amorphous core and for moving the coil to a position where an end of a leg of the amorphous core is inserted into the opening of the coil;

clamping means disposed so as to face ends of the legs of the U-shaped amorphous core, for clamping the end of at least one of the legs of the U-shaped amorphous core;

positioning means for moving said clamping means to the predetermined position of the amorphous core; and control means for controlling operation of said coil holding means, said clamping means and said positioning means such that first said coil holding means is driven to a position where said clamping means is inserted into the opening of the coil and then said coil holding means is driven to a position where the at least one of the legs of the amorphous core is inserted into the opening of the coil after said clamping means has clamped the at least one of the legs of the amorphous core.

2. An amorphous core/coil assembling apparatus according to claim 1, further comprising:

dust collecting means connected to a bottom portion of said clamping means for sucking fragments of amorphous metal within said clamping means; and wherein said control means further controls operation of said dust collecting means.

3. An amorphous core/coil assembling apparatus for inserting end portions of a pair of legs of an amorphous core, formed from a layered amorphous material and having a substantially U-shaped profile, into a pair of coils to assemble the core and coils, said apparatus comprising:

a pair of movement guide members, each movement guide member being openable and closable so as to form a V-shaped opening, each of said movement guide members having a dust collection suction hole formed in a base portion thereof;

fixation means for fixing the amorphous core at a predetermined position;

positioning means for moving said movement guide members to the predetermined position of the amorphous core and guiding said movement guide members such that the ends of said movement guide members are opposed to the ends of the legs of the U-shaped amorphous core;

a V-shape opening adjustment mechanism for adjusting the width of the V-shaped openings of said movement guide members;

driving means for driving said V-shape opening adjustment mechanism;

a dust collector connected to the suction holes of said movement guide members for sucking air from within said movement guide members; and control means for controlling operation of said movement guide members, said fixation means, said positioning means, said V-shaped opening adjustment mechanism, said driving means, and said dust collector.

4. An amorphous core/coil assembling apparatus for inserting end portions of a pair of legs of an amorphous core, formed from a layered amorphous material and having a substantially U-shaped profile, into a pair of coils to assemble the core and coils, said apparatus comprising:

a pair of movement guide members, each movement guide member being openable and closable so as to form a V-shaped opening said movement guide members including an adjustment mechanism for adjusting the width of the V-shaped openings of said movement guide members and the dimension of said movement guide members in a direction perpendicular to the direction of the width of the openings;

fixation means for fixing the amorphous core at a predetermined position;

positioning means for moving said movement guide members to the predetermined position of the amorphous core and guiding said movement guide members such that the ends of said movement guide members are opposed to the ends of the legs of the U-shaped amorphous core;

driving means for driving said adjustment mechanism; and control means for controlling operation of said movement guide members, said fixation means, said positioning means, and said driving means.

* * * * *